US008131173B2

(12) United States Patent
Noguchi et al.

(10) Patent No.: US 8,131,173 B2
(45) Date of Patent: Mar. 6, 2012

(54) DRIVING APPARATUS AND IMAGE FORMING APPARATUS

(75) Inventors: Hidetaka Noguchi, Hyogo (JP); Toshiyuki Andoh, Kanagawa (JP); Takashi Hodoshima, Kanagawa (JP); Seiji Hoshino, Kanagawa (JP); Tatsuhiko Oikawa, Kanagawa (JP); Takashi Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 742 days.

(21) Appl. No.: 12/314,312

(22) Filed: Dec. 8, 2008

(65) Prior Publication Data

US 2009/0162118 A1 Jun. 25, 2009

(30) Foreign Application Priority Data

Dec. 19, 2007 (JP) ..... 2007-326798

(51) Int. Cl.
*G03G 15/20* (2006.01)
*G03G 15/00* (2006.01)

(52) U.S. Cl. ..... 399/68; 399/36

(58) Field of Classification Search ..... 399/36, 399/68

See application file for complete search history.

(56) References Cited

U.S. PATENT DOCUMENTS

| | | | |
|---|---|---|---|
| 2008/0175612 | A1 | 7/2008 | Oikawa et al. |
| 2008/0232880 | A1 | 9/2008 | Noguchi et al. |

FOREIGN PATENT DOCUMENTS

| | | |
|---|---|---|
| JP | 2003-215870 | 7/2003 |
| JP | 2004-054120 | 2/2004 |
| JP | 2005-107118 | 4/2005 |
| JP | 2006-227034 | 8/2006 |

*Primary Examiner* — David Gray
*Assistant Examiner* — Andrew Do
(74) *Attorney, Agent, or Firm* — Harness, Dickey & Pierce, PLC

(57) ABSTRACT

A driving apparatus includes a driving unit, a driven unit driven by the driving unit, a driving control unit configured to control the driving unit by performing feed-forward control based on feed-forward target data determined in advance to reduce a speed change of the driven unit. The speed change of the driven unit is expressed substantially as a positive half cycle of a sinusoidal waveform having an amplitude and a time duration, and the feed-forward target data is calculated from the amplitude and the time duration to represent a rectangular waveform approximating the positive half cycle of the sinusoidal waveform.

14 Claims, 11 Drawing Sheets

DRIVING APPARATUS AND IMAGE FORMING APPARATUS

BACKGROUND OF THE INVENTION

1. Field of the Invention

The present invention relates to a driving apparatus used for an image forming apparatus such as a printer, a facsimile machine, and a multifunction peripheral, and to an image forming apparatus using the driving apparatus.

2. Description of the Related Art

In recent years, many color image forming apparatuses have employed an intermediate transfer method, by which a toner image on a photosensitive body undergoes primary transfer onto an intermediate transfer body such as an intermediate transfer drum or an intermediate transfer belt in a primary transfer unit, and then the toner image of four colors on this intermediate transfer body undergoes secondary transfer onto a sheet member in a secondary transfer unit. The image forming apparatus using the intermediate transfer body is highly versatile and advantageous since various kinds of sheet members can be used such as thin paper, thick paper, postcards, and envelopes.

When a sheet member with a certain thickness or more enters the secondary transfer unit, however, there is caused a defect in that the speed of the intermediate transfer body which has been driven at a constant speed changes for a short period of time so that an image is transferred with a distortion in the primary transfer unit.

Further, there is an apparatus which simultaneously performs transfer and fixation of an image onto a sheet member since the secondary transfer unit and a fixation unit have become closer to each other in accordance with the downsizing of color image forming apparatuses. In this apparatus also, when a sheet member with a certain thickness or more enters the fixation unit, there is caused a problem in that the speed of a fixation roller or a fixation belt which have been driven at a constant speed changes for a short period of time, and thus an image is transferred with a distortion in the secondary transfer unit.

These defects can be avoided by estimating a timing when the speed change will be generated in the intermediate transfer body or the like before the sheet member enters the secondary transfer unit or the fixation unit and increasing the speed of the intermediate transfer body or the like when the sheet member enters the secondary transfer unit or the fixation unit to cancel out the speed change, which is called feed-forward control (see Patent Documents 1, 2, and the like). The timing when the speed change is generated can be estimated by using a sheet member sensor provided right before the fixation unit, as in an image forming apparatus disclosed in, for example, Patent Document 3. That is, the time from when the sheet member sensor senses the sheet member to when the sheet member enters the fixation unit is measured in advance. With the sensing of the sheet member as a start point, at a timing after the measured time has passed, the estimated speed change is generated.

[Patent Document 1] Japanese Patent Application Publication No. 2003-215870

[Patent Document 2] Japanese Patent Application Publication No. 2005-107118

[Patent Document 3] Japanese Patent Application Publication No. 2004-54120

FIGS. 15A and 15B are schematic diagrams showing the feed-forward control. A speed change Va can be expressed by a waveform of a velocity component in a predetermined period as shown in FIG. 15A. For example, as the feed-forward control of the case when the speed change Va is generated in the intermediate transfer body, the intermediate transfer body is controlled to be driven at a speed Vb which cancels out the speed change Va. As a result, the speed change Va can be canceled out and the intermediate transfer body can be driven at a constant speed as shown in FIG. 15B.

Here, when the speed change Va is generated for 100 ms and the speed of the intermediate transfer body is controlled by 1 ms increments to cancel out the speed change Va, 100 pieces of speed data to cancel out the speed change Va are required to be recorded in a recording unit. Further, more pieces of data are required to be recorded to cancel out plural different speed changes. Therefore, the recording unit is required to have a large recording area. Moreover, when the feed-forward control is performed, the data are required to be read per 1 ms from the recording unit by an operation unit for 100 ms when the speed change is generated, and the read data are required to be outputted to a driving control unit which controls driving of the intermediate transfer body. Since the operation unit is highly loaded, an operation processing property may be decreased and the appropriate feed-forward control may not be performed.

To solve this problem, a recording unit with a large recording area or a high performance operation unit which can sustain a high work load may be provided. However, there are resulting problems such as increase in manufacturing cost.

SUMMARY OF THE INVENTION

In view of the aforementioned circumstances, it is an object of at least one embodiment of the present invention to provide a driving apparatus which can appropriately perform feed-forward control of a driving unit at low cost and to provide an image forming apparatus using the driving apparatus.

According to one aspect of the invention, a driving apparatus includes a driving unit, a driven unit driven by the driving unit, a driving control unit configured to control the driving unit by performing feed-forward control based on feed-forward target data determined in advance to reduce a speed change of the driven unit. The speed change of the driven unit is expressed substantially as a positive half cycle of a sinusoidal waveform having an amplitude and a time duration, and the feed-forward target data is calculated from the amplitude and the time duration to represent a rectangular waveform approximating the positive half cycle of the sinusoidal waveform.

According to at least one embodiment, there is provided a superior effect in that feed-forward control of the driving unit can be appropriately performed at low cost as described below.

DETAILED DESCRIPTION OF THE PREFERRED EMBODIMENTS

Embodiment 1

Figure 1:
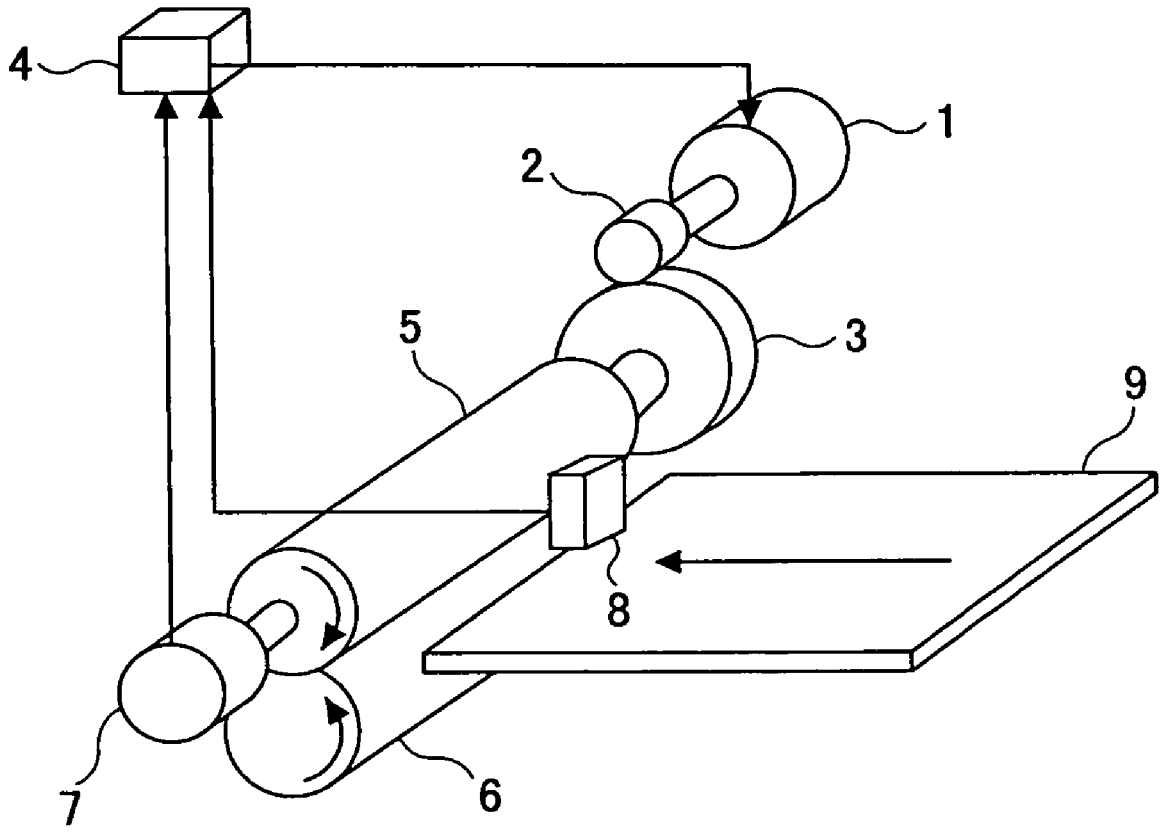
FIG. 1 is a schematic view of a driving system.

FIG. 1 is a view showing an example of a driving apparatus to which the invention can be applied. The driving apparatus includes a driving source 1, a drive transmission unit formed of a small diameter gear 2 and a large diameter gear 3, a driving control unit 4, a driven unit formed of a driving roller 5 and a driven roller 6, a rotation data obtaining unit 7 which obtains rotation data of the driven unit, and an estimation unit 8 which estimates an abrupt speed change to be generated in the driven unit.

A brushless DC motor, a pulse motor, an ultrasonic motor, a direct drive motor, and the like can be used as the driving source 1.

A speed reducer mechanism such as a pulley and a V belt, a worm gear, a gear and a toothed belt, and a planet gear mechanism can be used as the drive transmission unit besides the array of gears shown in FIG. 1. Further, when an ultrasonic motor or a direct drive motor is used as the driving source, the driven unit can be directly driven without using a drive transmission system, due to the characteristics of these motors.

The driving control unit 4 is mainly formed of a feed-back controller, feed-forward controller, and a driver and controls the driving source 1. The feed-back controller receives the rotation data of the driven unit from the rotation data obtaining unit 7 and controls the driven unit so as to drive it at a desired rotation speed. The feed-forward controller performs feed-forward control to cancel out an abrupt speed change which can be estimated. The driver supplies power to the driving source 1 in accordance with instruction values from the feed-back controller and the feed-forward controller.

The driven unit is formed of a load supported to be capable of rotating or running, such as a pair of the rollers shown in FIG. 1, a single roller, and a driving roller and a support roller with a belt looped around them.

As the rotation data obtaining unit 7, a rotary encoder supported on the same axle as the roller, or a linear encoder which reads a linear scale on the roller or the belt can be used. Further, the rotation data of the driving source may be used as the rotation data of the driven unit. In this case also, a rotary encoder or a linear encoder can be used or an FG signal outputted from the driving source in accordance with the rotational speed may be used as well to obtain the rotation data of the driving source. Moreover, when using the pulse motor or the ultrasonic motor as the driving source 1, the driving apparatus may be driven closed-loop without having the rotation data obtaining unit 7.

The estimation unit 8 estimates an abrupt load change generated in the driven unit, which is a cause of the abrupt speed change. In FIG. 1, for example, when a sheet member 9 is sandwiched between the pair of rollers formed of the driving roller 5 and the driven roller 6 which are driven to rotate, an abrupt speed change is generated in the driving roller 5. At this time, the estimation unit 8 serving as a sensor to sense the sheet member can estimate that a speed change of the driven unit will be generated after the time determined by a sheet member carry speed and the distance between the sensor and a roller pressure contact part has passed after the estimation unit 8 senses the sheet member. An optical sensor, a magnetic sensor, an ultrasonic sensor, or the like can be used as the sensor.

An abrupt speed change is generated in the driven unit when a sliding member or a rotational member contacts or is spaced apart from the roller or the belt which is driven to rotate. In FIG. 1, for example, when the driven roller 6 contacts or is spaced apart from the driving roller 5 by a driving unit which is not shown, the estimation unit 8 is used as a displacement sensor to sense the displacement of the driven roller 6, thereby the abrupt speed change is estimated. An optical sensor, a strain gauge, an acceleration sensor, or the like can be used as the displacement sensor. Further, an operation signal or an operation instruction signal of the driving source, which is used for the contact and spacing operations of the sliding member or the rotational member, can be used instead of the estimation unit 8 as well.

Figure 2:
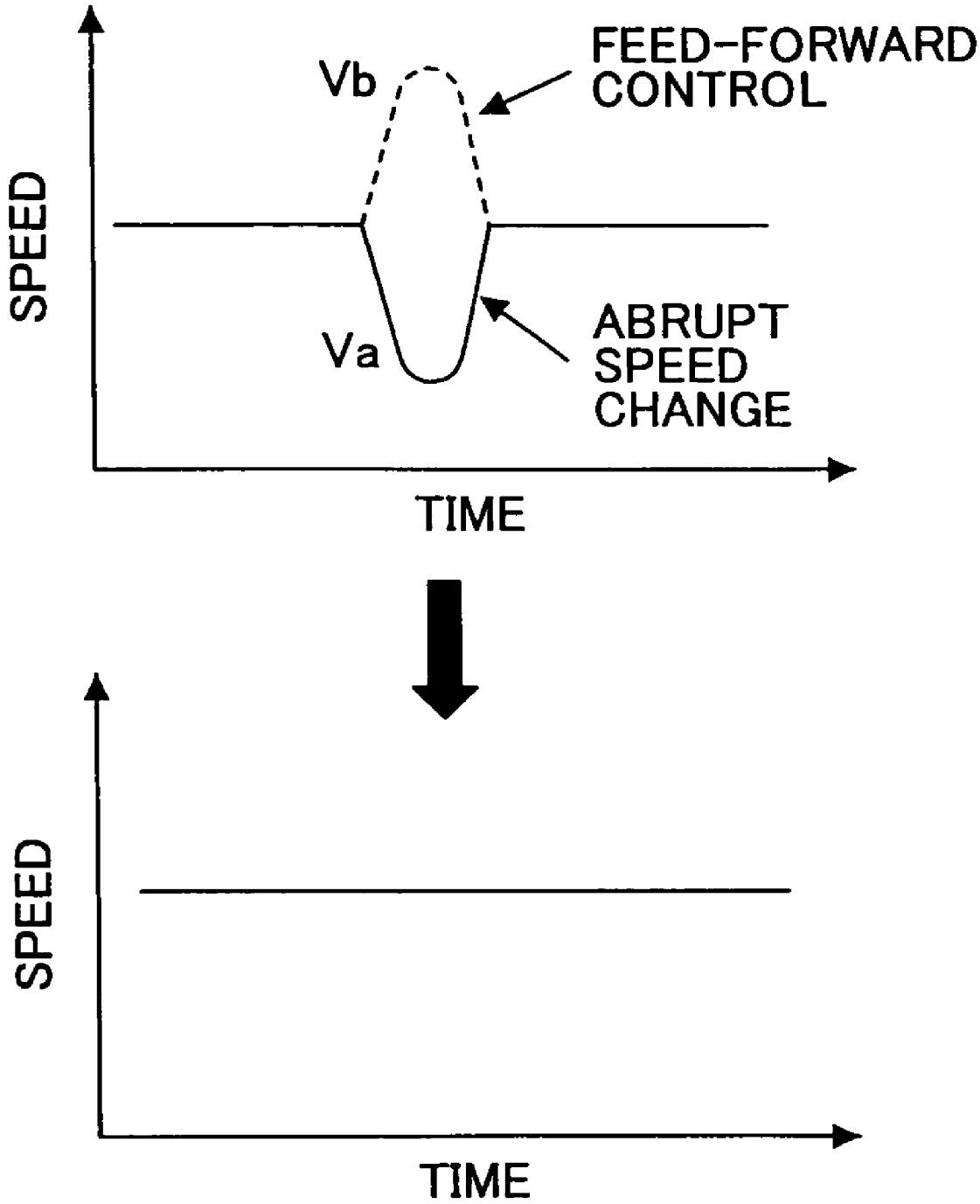
FIG. 2 is a schematic diagram showing feed-forward control.

FIG. 2 is a schematic diagram showing the feed-forward control. In the feed-forward control, the driven unit is driven at a speed Vb so as to cancel out an abrupt speed change Va caused in the driven unit. As a result, the speed change of the driven unit can be canceled out and the driven unit can be driven at a constant speed.

Figure 3:
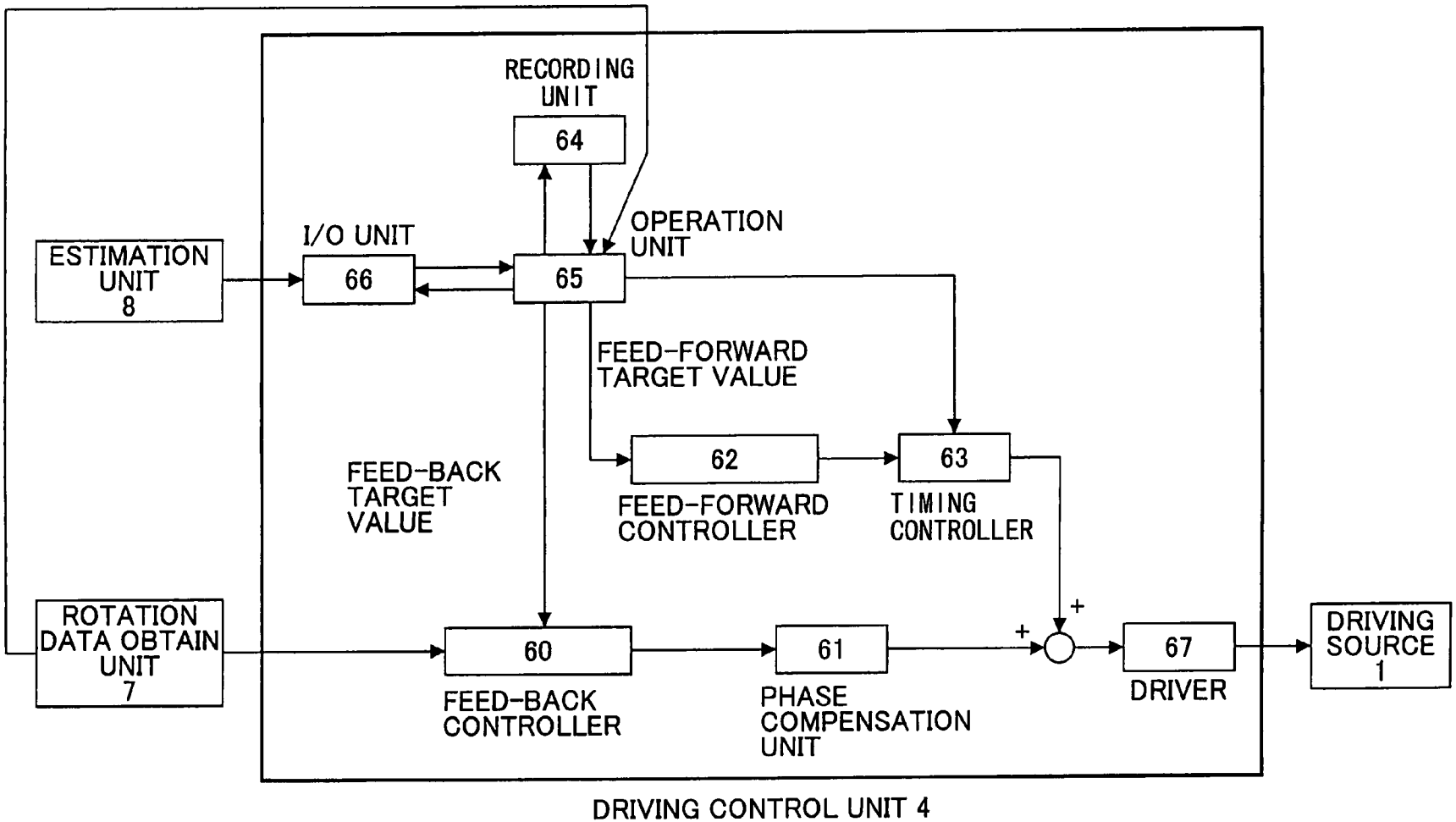
FIG. 3 is a block diagram showing a driving control apparatus.

FIG. 3 is a diagram showing details of the driving control unit 4. The driving control unit 4 includes a feed-back controller 60, a phase compensation unit 61, feed-forward controller 62, a timing controller 63, a recording unit 64, an operations unit 65, an I/O unit 66, a driver 67, and the like. The feed-back controller 60 compares the rotation data from the rotation data obtaining unit 7 and a feed-back target value stored in the recording unit 64 and calculates a driving instruction value so that their difference becomes close to zero, thereby the driving source 1 is controlled. The phase compensation unit 61 compensates for a gain margin and a phase margin.

When the I/O unit 66 receives an estimation sensor signal from the estimation unit 8, the feed-forward controller 62 converts the feed-forward target data stored in the recording unit 64 into a feed-forward driving instruction value. The feed-forward target data is obtained by using a test device in which an equivalent speed change to the speed change of the driving roller 5 is generated to calculate the speed change. The measured speed change is converted into the feed-forward target data by using a computer. In this manner, the feed-forward target data obtained in advance by using the test device or the like is stored in the recording unit 64. Further, as the feed-forward target data differs depending on the profile of the generated speed change, feed-forward target data corresponding to each speed change is obtained by the experimental plane and the like in advance and stored in the recording unit 64. The timing controller 63 outputs a feed-forward driving instruction value in accordance with a feed-forward timing stored in the recording unit 64. Note that the feed-forward timing is a time from when the estimation unit 8 estimates the generation of the speed change to when the speed change is actually generated in the driven unit.

The driving instruction value outputted by the feed-back controller 60 and the feed-forward driving instruction value outputted by the feed-forward controller 62 are added and outputted to the driver 67. The instruction values may be added by using an adder using an operational amplifier or the like, or processed digitally in the driving control unit 4. The driver 67 supplies power to the driving source 1 in accordance with the received instruction value to drive the driving source 1.

EXAMPLE 1

In the feed-forward control of the present invention, the feed-forward target data is converted into a rectangular waveform and stored in the recording unit 64. Details of this process are described below. Note that the feed-forward target data is converted into the rectangular waveform when converting the data of the speed change measured by the test device into the feed-forward target data by the computer.

Figure 4:
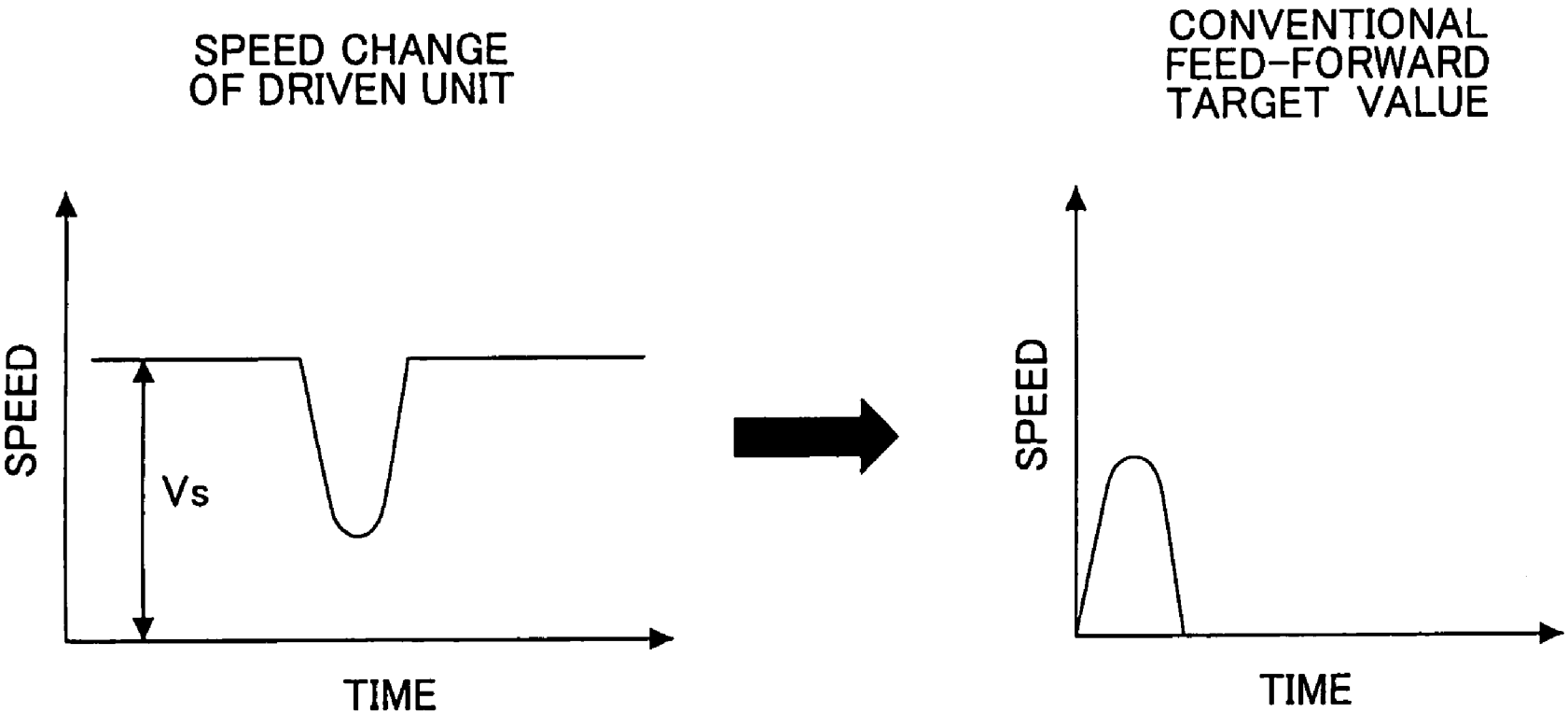
FIG. 4 is a diagram showing a method to generate conventional feed-forward target data.

FIG. 4 is a schematic diagram showing a conversion from the speed change of the driven unit into conventional feed-forward target data. A steady speed Vs of the driven unit as an offset amount is removed from the measured data of the speed change, positive and negative of the data are inverted, and only the speed changing part is taken out and used as the conventional feed-forward target data. Moreover, when the amount of speed change of the driven unit varies, an average value of the plural speed changes is converted into feed-forward target data. Consequently, a stable feed-forward control effect can be obtained even when the speed changes vary. Conventionally, the feed-forward target data obtained in this manner is stored as it is in the recording unit.

For example, when the speed change in FIG. 4 is generated for 100 ms and the control cycle is 1 ms, 100 pieces of data obtained by a formula 100 ms/1 ms are required to be stored in the recording unit as feed-forward target data. Therefore, there is conventionally a problem in that a large memory area is required to cancel out the plural different speed changes.

Figure 5:
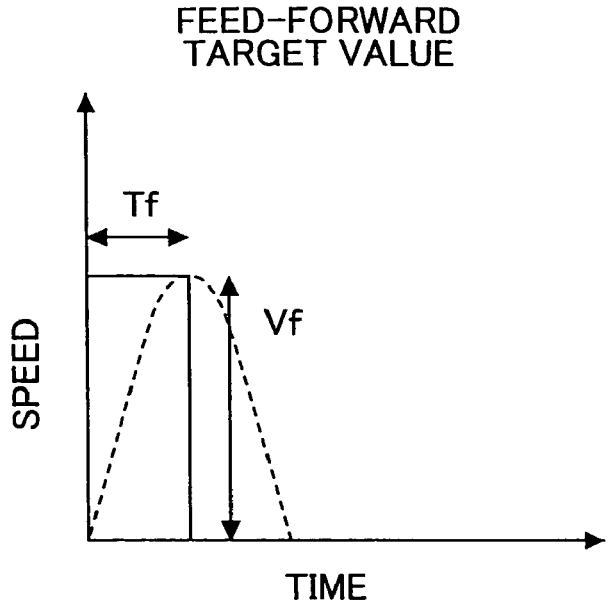
FIG. 5 is a diagram showing conversion from the conventional feed-forward target data to rectangular waveform feed-forward target data.

FIG. 5 is a schematic diagram showing a method to convert the feed-forward target data into a rectangular waveform. In FIG. 5, the conventional feed-forward target data is expressed by a broken line and a rectangular waveform feed-forward target data is expressed by a solid line. One of the methods to convert the feed-forward target data into the rectangular waveform is to set amplitude Vf of the rectangular waveform feed-forward target data at maximum amplitude of the conventional feed-forward target data and set a time duration Tf of the rectangular waveform feed-forward target data as the time taken until the conventional feed-forward target data reaches the maximum amplitude.

Figure 6:
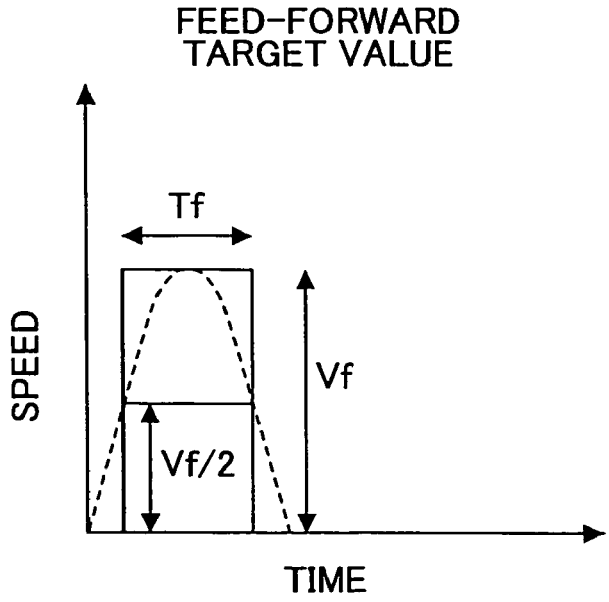
FIG. 6 is a diagram showing conversion from the conventional feed-forward target data to rectangular waveform feed-forward target data.

Moreover, when the driving source and the driven unit are highly compliant with the driving instruction value, the time duration Tf of the rectangular waveform feed-forward target data may be set as the time duration of a half maximum amplitude of the conventional feed-forward target data as shown in FIG. 6. When sufficient control effect is not provided even by converting the rectangular waveform feed-forward target data by these methods, the amplitude Vf and the time duration Tf are to be fine-tuned in accordance with each driving system.

Here, by converting the feed-forward target data into a rectangular waveform, only the amplitude Vf and the time duration Tf are required to be stored in the recording unit 64. As a result, a recording area to be used can be largely reduced and thus it becomes easy to cancel out the plural speed changes. Further, when the conventional feed-forward target data is used, the target value is required to be read out from a recording unit and outputted to a feed-forward controller per control cycle, which increases a load on an operation unit. When using the rectangular waveform feed-forward target data of the embodiment, on the other hand, once the amplitude Vf is read out from the recording unit 64, the amplitude Vf is to be continuously outputted for the time duration of Tf. Therefore, the work load on the operations unit 65 can be largely reduced as well.

That is to say, by using a rectangular waveform amplitude having an opposite phase to a positive half cycle of a waveform expressing a speed change as a feed-forward target data, the feed-forward target data is constant at any time in the period when the speed change is generated, since the amplitude of the rectangular waveform is constant. Therefore, in the case of the feed-forward control, the control unit 4 reads out the feed-forward target data from the recording unit 64 only once. By using only the read feed-forward target data as feed-forward target data in the period, the feed-forward control is performed. As a result, the number of times that the control unit 4 reads out the feed-forward target data from the recording unit 64 can be reduced. In addition, the work load on the control unit 4 can be reduced by reading out the feed-forward target data from the recording unit 64. Therefore, a high performance control unit 4 is not required, for which manufacturing cost of the driving apparatus can be reduced.

As another effect of converting the feed-forward target data into a rectangular waveform, there is an advantage that precision of the feed-forward control can be improved since the speed of the driven unit after the feed-forward control can be closer to the feed-forward target data. This advantage is described below with reference to FIGS. 7 and 8.

Figure 7:
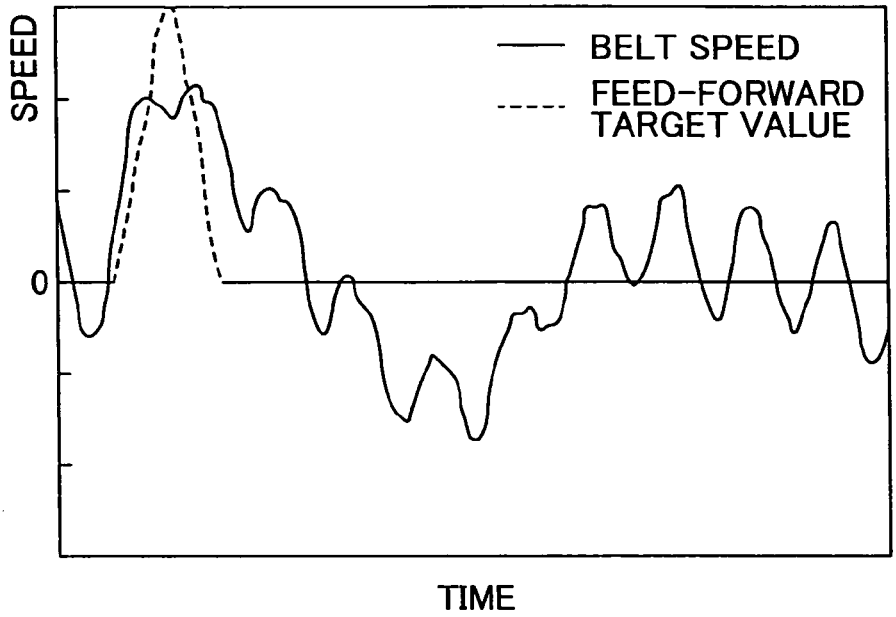
FIG. 7 is a graph showing a speed change of a belt when the conventional feed-forward target data is used.
Figure 8:
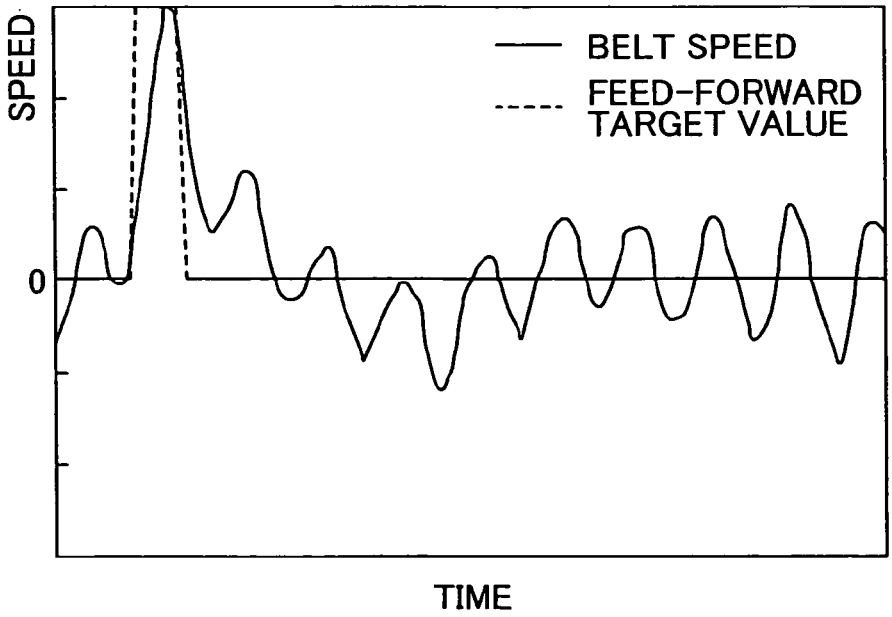
FIG. 8 is a graph showing a speed change of a belt when the rectangular waveform feed-forward target data is used.

FIGS. 7 and 8 are diagrams each showing changes of a belt speed in the case where only predetermined feed-forward target data is inputted to control driving of the intermediate transfer belt in a normal driving state, which belt serves as the driven unit. FIG. 7 shows the case of using a conventional sinusoidal waveform feed-forward target data while FIG. 8 shows the case of using a rectangular waveform feed-forward target data (with the same amplitude as the conventional target value and a time duration of the half maximum amplitude of the conventional target value. See FIG. 6). As shown in FIG. 7, when using the conventional sinusoidal waveform feed-forward target data (broken line), the speed of the intermediate transfer belt has an obtuse waveform (solid line) with lower amplitude and a larger time duration with respect to those of desired feed-forward target data. That is, the feed-forward target data and the actual belt speed after the feed-forward control using the target value are largely different from each other. On the other hand, as shown in FIG. 8, when using the rectangular waveform feed-forward target data (broken line) formed by converting the desired sinusoidal waveform feed-forward target data, the belt speed drastically changes (solid line), and the waveform (broken line) is quite close to the waveform of the desired feed-forward target data expressed by the broken line in FIG. 7.

A control effect of actually using the rectangular waveform feed-forward target data is described with experimental results.

Figure 9:
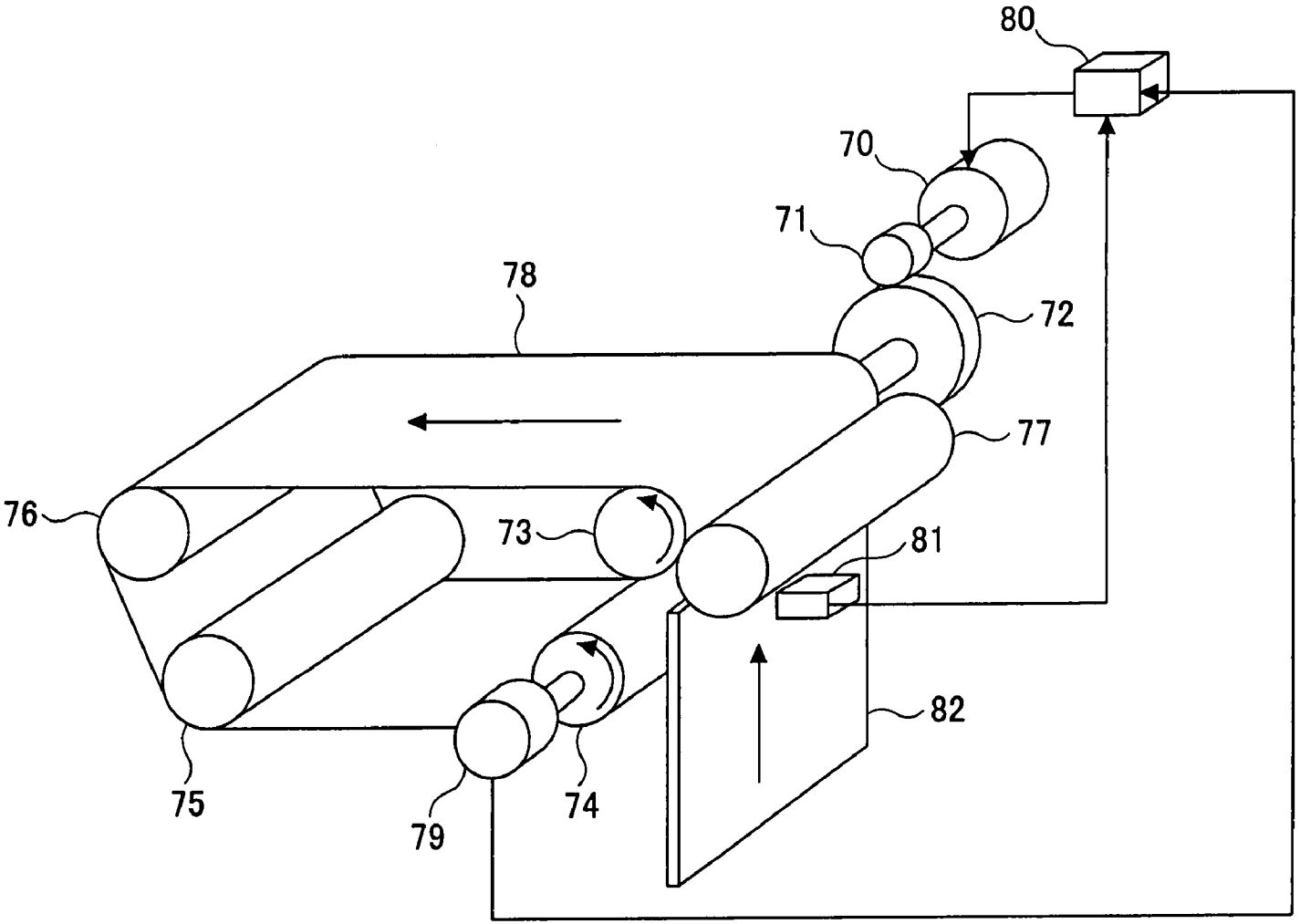
FIG. 9 is a schematic configuration view of a belt driving apparatus.

This experiment was conducted by using a belt driving apparatus shown in FIG. 9. The belt driving apparatus corresponds to the driving system shown in FIG. 1, including a driven unit formed of a driving roller 73, support rollers 74, 75, and 76, a driven roller 77, and an endless belt 78. Moreover, at a pressure contact part between the driving roller 73 and the driven roller 77, a sheet member 82 is sandwiched and carried. When the sheet member 82 enters the pressure contact part, an abrupt speed change is generated in the endless belt 78. The speed of the endless belt 78 was measured by a rotary encoder 79 provided on the same axle as the support roller 74. An optical sensor 81 was used as a unit to measure the speed change generated in the endless belt 78. The optical sensor 81 estimated a timing at which the sheet member entered the roller pressure contact part by sensing a tip of the sheet member.

Figure 10:
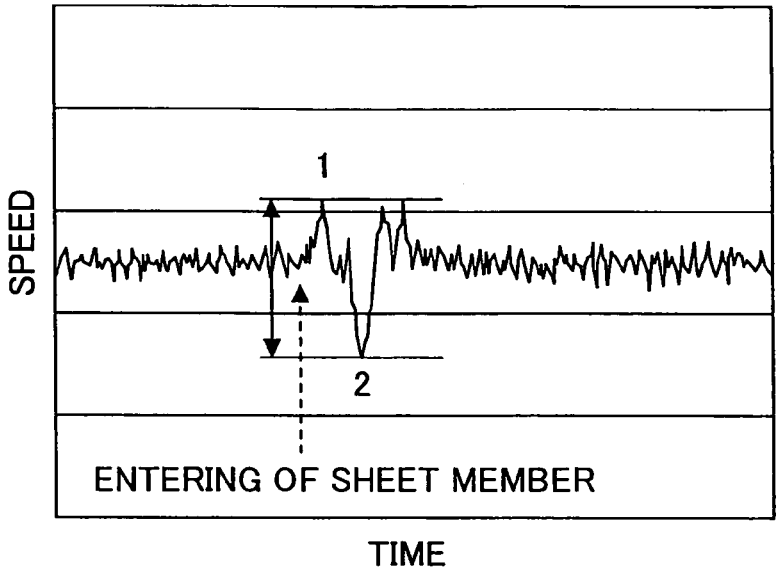
FIG. 10 is a graph showing a speed change generated by entering of a sheet member.

FIG. 10 is a diagram showing a speed change of the endless belt 78 generated when the sheet member 82 entered the pressure contact part. As shown in FIG. 10, when the feed-forward control was not performed, a speed change 1 and a speed change 2 were generated. Therefore, feed-forward control was required to cancel out these speed changes.

Figure 11:
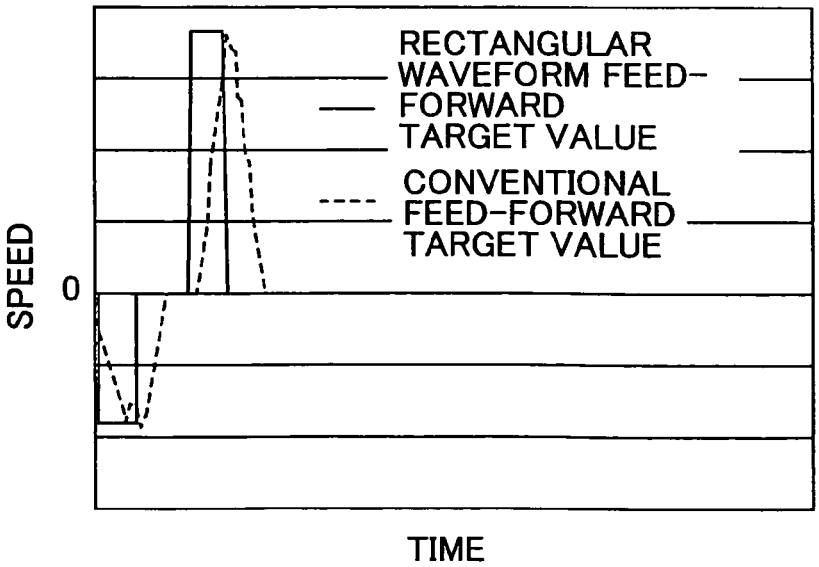
FIG. 11 is a graph showing the conventional and rectangular waveform feed-forward target data.

FIG. 11 is a diagram showing feed-forward target data converted by the method shown in FIG. 5. Rectangular waveform feed-forward target data is expressed by a solid line and conventional feed-forward target data is expressed by a broken line.

Figure 12:
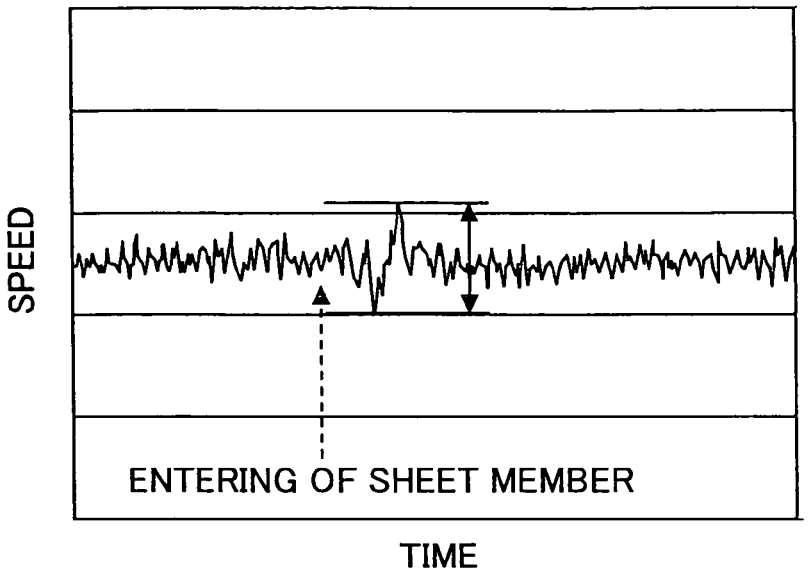
FIG. 12 is a graph showing a speed change of the case where feed-forward control is performed by using the conventional feed-forward target data.
Figure 13:
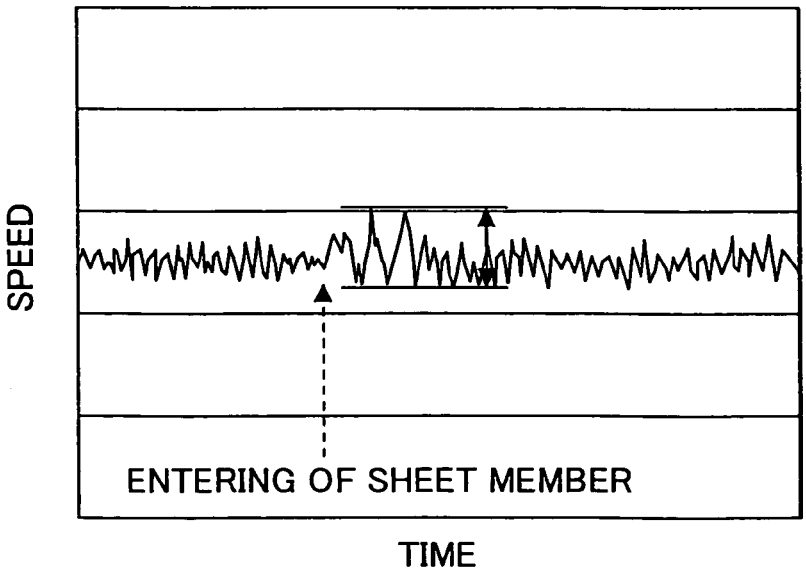
FIG. 13 is a graph showing a speed change of the case where the feed-forward control is performed by using the rectangular waveform feed-forward target data.

FIG. 12 is a diagram showing a speed change of the endless belt when the feed-forward control was performed by using the conventional feed-forward target data. FIG. 13 is a diagram showing a speed change of the endless belt when the feed-forward control was performed by using the rectangular waveform feed-forward target data. When FIGS. 10 and 12 or 10 and 13 are compared, an abrupt speed change generated by the entering sheet member was suppressed in the case of FIGS. 12 and 13 in which the feed-forward control was performed, compared to the case of FIG. 10 in which the feed-forward control was not performed. Further, when FIGS. 12 and 13 are compared, a P-P value (peak to peak value, which is expressed by a solid arrow in FIGS. 12 and 13) of the speed change of the endless belt generated by the entering sheet member was smaller in FIG. 13 in which the rectangular waveform feed-forward target data was used. It can be seen that a higher feed-forward control effect was obtained when using the rectangular waveform feed-forward target data. In this manner, when the rectangular waveform feed-forward target data is used, a higher control effect can be obtained than the case of using the conventional feed-forward target data.

As described above, a recording area to be used and a load on the operations unit 65 can be largely reduced by the feed-forward control using the rectangular waveform feed-forward target data according to the embodiment of the invention. Moreover, an abrupt driving change generated in the driven unit can be suppressed.

Embodiment 2

The present invention is effective for all driving apparatuses having the configuration described in Example 1. There is an electrophotographic type image forming apparatus in which the effect of the invention is quite notable. The invention can be applied to an intermediate transfer apparatus, a fixation apparatus, and the like in the image forming apparatus. Though there are image forming apparatuses with various configurations, a multifunction peripheral as a tandem image forming apparatus employing the intermediate transfer method is taken as an example here as an image forming apparatus of a typical method.

Figure 14:
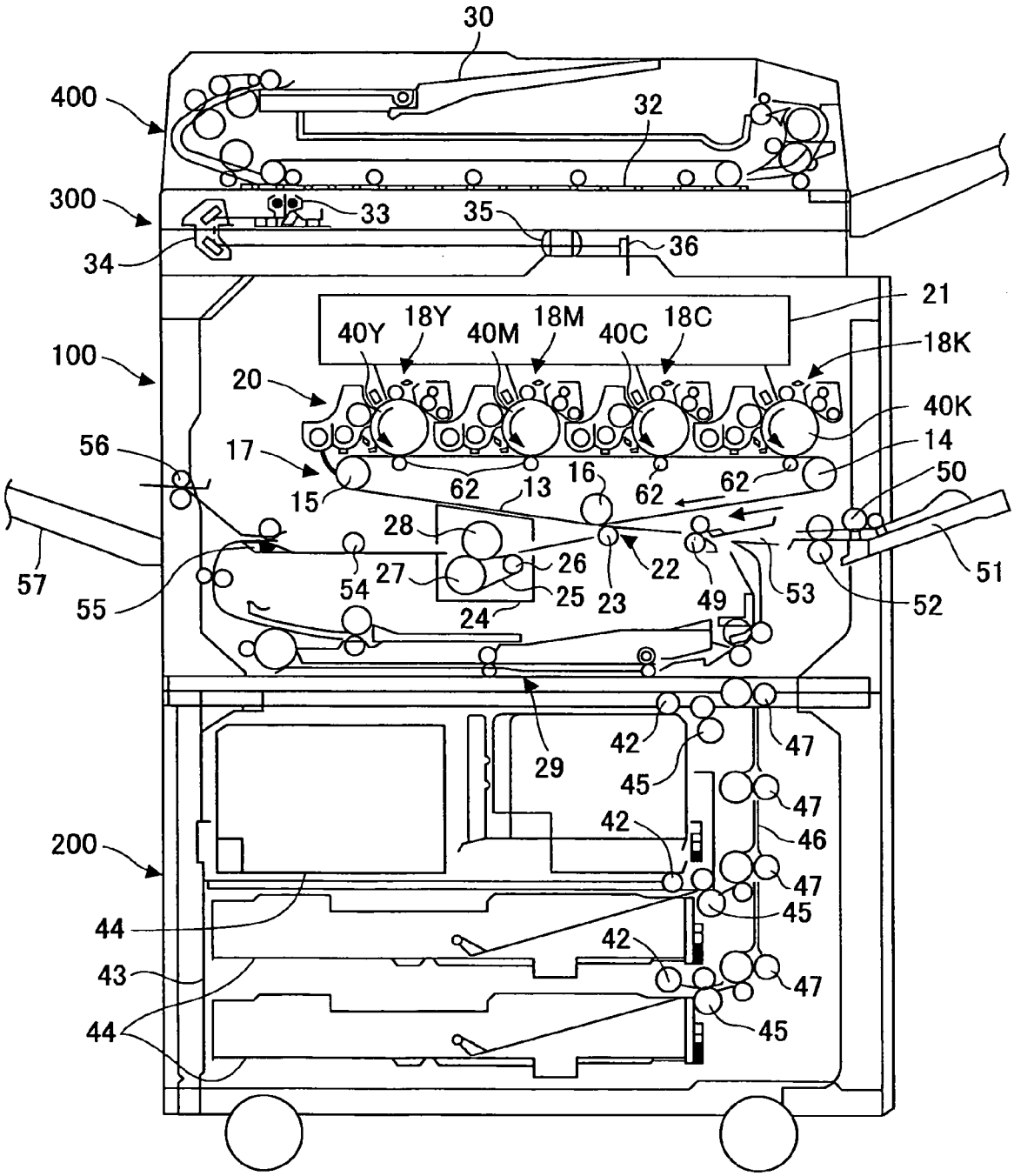
FIG. 14 is a schematic configuration view of a multifunction peripheral according to at least one embodiment.
Figure 15A:
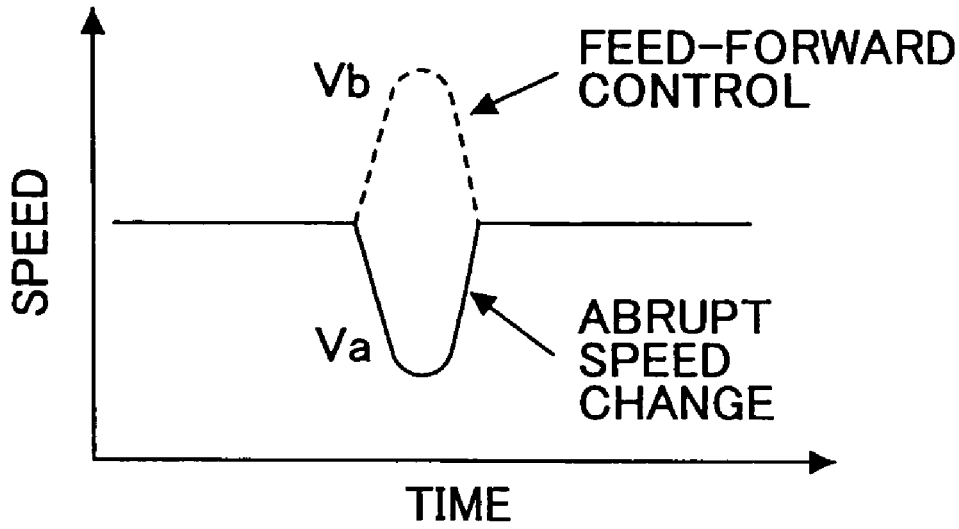
FIG. 15A is a schematic diagram showing feed-forward control, in which a speed change Va and a speed Vb to cancel out the speed change Va are shown.
Figure 15B:
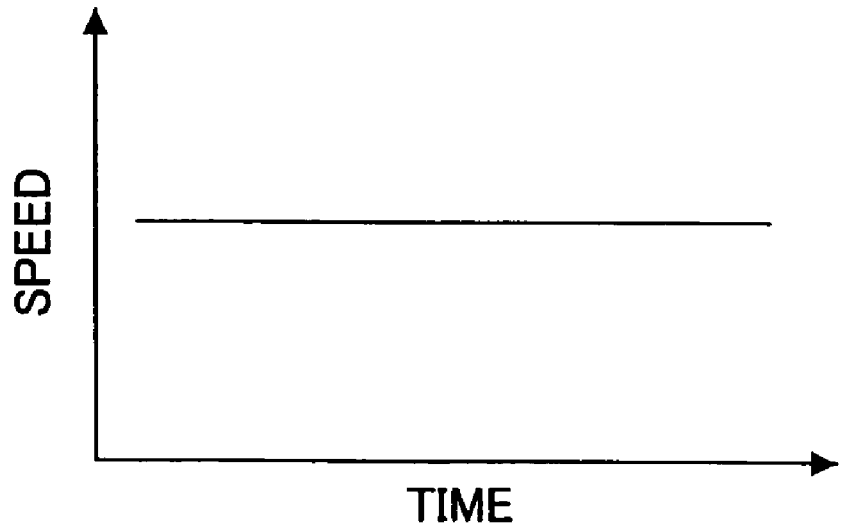
FIG. 15B is a graph in which the speed change is canceled out by the feed-forward control.

FIG. 14 is a schematic configuration diagram of a multifunction peripheral of this embodiment. In FIG. 14, a reference numeral 100 denotes a multifunction peripheral body, 200 denotes a paper feed table on which the multifunction peripheral body is mounted, 300 denotes a scanner mounted on the multifunction peripheral body 100, and 400 denotes an automatic document feeder (ADF) mounted on the scanner 300. Other reference numerals are described in the following description.

The endless intermediate transfer belt 13 is provided as an intermediate transfer body at a central area of the multifunction peripheral body 100. The intermediate transfer belt 13 is rotatable clockwise around the driving roller 14 and the two support rollers 15 and 16 in FIG. 14. The driving roller 14 is controlled by a driving source, a driving control unit, and a drive transmission unit which are not shown. Hereinafter, a rotational movement of the belt when partially seen is simply called a movement. An intermediate transfer belt cleaning device 17 to remove residual toner remaining on the intermediate transfer belt. 13 after the image transfer is provided on the left of the support roller 15 in FIG. 14. The support roller 15 also has a function as a tension roller which maintains the tension of the intermediate transfer belt constant. Pressure is applied to the support roller 15 by an elastic member such as a spring (not shown) from inside to outside of the intermediate transfer belt 13.

On the intermediate transfer belt 13 which extends between the driving roller 14 and the support roller 15, four image forming units 18 of yellow (Y), magenta (M), cyan (C), and black (K) are horizontally arranged, thereby a tandem image forming apparatus 20 is formed. Over the tandem image forming apparatus 20, an exposure apparatus 21 is further provided.

On an opposite side of the tandem image forming apparatus 20, on the other hand, a secondary transfer apparatus 22 is provided with the intermediate transfer belt 13 located between them. The secondary transfer apparatus 22 presses a secondary transfer roller 23 onto the support roller 16 with the intermediate transfer belt 13 sandwiched inbetween. The secondary transfer apparatus 22 transfers an image on the intermediate transfer belt 13 onto a sheet member, and at the same time carries the sheet member to a fixation apparatus 24. The fixation apparatus 24 which fixes the transferred image on the sheet member is provided beside the secondary transfer apparatus 22. In this manner, the secondary transfer apparatus 22 also has a function to carry the sheet member after the image transfer to the fixation apparatus 24.

The fixation apparatus 24 is formed of a fixation belt 25 which extends between a heating roller 26 and a fixation roller 27, and a pressure roller 28 which is pressed onto the fixation roller 27 with the fixation belt 25 sandwiched inbetween. The heating roller 26 also has a function as a tension roller to maintain tension of the fixation belt 25 constant. Pressure is applied from inside to outside of the fixation belt 25 by an elastic member such as a spring (not shown). The fixation belt 25 is heated by the heating roller 26 to a temperature which is required to fix the image. The transferred image on the sheet member is fixed on the sheet member by the heat and pressure.

It is to be noted that a sheet member inverting device 29 which inverts the sheet member to record images on both sides of the sheet member is provided in parallel with the tandem image forming apparatus 20 under the secondary transfer apparatus 22 and the fixation apparatus 24 in FIG. 14.

When making a copy by using this multifunction peripheral, a document is set on the document stage 30 of the automatic document feeder 400. Alternatively, the automatic document feeder 400 is opened and a document is set on a contact glass 32 of the scanner 300, and then the automatic document feeder 400 is closed to press the document. Then, by pressing a start switch (not shown), the document set on the automatic document feeder 400 is carried onto the contact glass 32. When the document is set on the contact glass 32, the scanner 300 is driven right away. Subsequently, a first running body 33 and a second running body 34 move. Then, light from a light source is emitted from the first running body 33, and at the same time the light reflected by the document is further reflected to be transmitted to the second running body 34. The light is reflected by a mirror of the second running body 34 and taken into a read-in sensor 36 through an imaging lens 35, thereby the content of the document is read in.

In parallel with the reading of the document, the driving roller 14 is rotated so that the other two support rollers are rotated and the intermediate transfer belt 13 is rotated. At the same time, a photosensitive drum 40 is rotated in each of the image forming units 18. Monochrome toner images are formed on the photosensitive drums 40 by exposure and development using respective color data of yellow, magenta, cyan, and black. Then, by sequentially transferring the monochrome toner images onto the moving intermediate transfer belt 13, a superposed four color image is formed on the intermediate transfer belt 13.

In parallel with the image formation, one of paper feed rollers 42 in the paper feed table 200 is selected and rotated and sheet members are supplied from one of plural stages of supply paper cassettes 44 provided in a paper bank 43. The sheet members are separated one by one by corresponding separation rollers 45, put in a supply paper path 46, carried by carry rollers 47 to be guided into a paper feed path in the multifunction peripheral body 100, and stopped at resist rollers 49. Alternatively, a paper feed roller 50 is rotated to supply sheet members provided on a manual paper tray 51 by rotating the paper feed roller 50. Then, the sheet members are separated one by one by separation rollers 52 and put into a manual paper feed path 53, and stopped at the resist rollers 49. The resist rollers 49 are then rotated at a timing corresponding to the superposed four color image on the intermediate transfer belt 13, the sheet member is sent between the intermediate transfer belt 13 and the secondary transfer apparatus 22, and the superposed four color image is transferred and recorded onto the sheet member by the secondary transfer apparatus 22.

Heat and pressure are applied by the fixation apparatus 24 to the sheet member onto which the image is transferred, thereby the transferred image is fixed. The sheet member is then carried by a carry roller 54 toward a paper output tray 57, changed in direction by a switching claw 55, and outputted by an output roller 56 to be stacked on the paper output tray 57. Alternatively, the sheet member is changed in direction by the switching claw 55 to be put in the sheet inverting device 29 where the sheet member is inverted and guided to the transfer position again. After an image is recorded on a back surface of the sheet member, the sheet member is outputted by the output roller 56 onto the paper output tray 57.

Residual toner on the intermediate transfer belt 13 after the image transfer is removed by the intermediate transfer belt cleaning device 17, so that the tandem image forming apparatus 20 is prepared to form an image again. In general, the resist rollers 49 are often used in a grounded state, however, a bias voltage can also be applied to the resist rollers 49 to remove paper dust of the sheet members.

By using this electrophotographic image forming apparatus, a monochrome copy of black and white is often made. In that case, the intermediate transfer belt 13 is spaced away from the photosensitive drums 40Y, 40C, and 40M by a unit which is not shown. These photosensitive drums are temporarily deactivated so that only the photosensitive drum 40K for black contacts the intermediate transfer belt 13 to form and transfer an image.

EXAMPLE 2

When a sheet member with a certain thickness or more enters the secondary transfer apparatus 22 or is spaced away from the secondary transfer apparatus 22 in the multifunction peripheral of this embodiment, an abrupt speed change is generated in the intermediate transfer belt 13. Moreover, a similar speed change is generated in the fixation apparatus as well. These problems can be solved by applying the invention to the intermediate transfer apparatus, the fixation apparatus, and the like.

When the invention is applied to the intermediate transfer apparatus, a sheet member sensor unit is required to be provided between the resist rollers 49 and the secondary transfer apparatus 22. An optical sensor, an ultrasonic sensor, a magnetic sensor, and the like can be used as the sensor unit. When the sheet member sensor unit senses a sheet member, the driving roller 14 is controlled by a control method similar to Example 1, thereby an abrupt speed change generated in the intermediate transfer belt 13 is suppressed.

When the sheet member sensor unit cannot be provided, operation signals of components in preceding stages of the secondary transfer apparatus 22, such as an operation control signal of the resist rollers 49 or a control signal of a resist clutch which is not shown may be used. Further, before the sheet member enters the secondary transfer apparatus 22, the sheet member may contact the intermediate transfer belt 13. By sensing a speed change and a displacement of the intermediate transfer belt 13 at that time, entering of the sheet member may be sensed.

In the case of performing the feed-forward control for a speed change generated when the sheet member is separated from the secondary transfer apparatus 22, a rear end of the sheet member is sensed by the sheet member sensor unit, thereby an abrupt speed change generated in the intermediate transfer apparatus is estimated. A control method here is similar to the case when the sheet member enters the secondary transfer apparatus 22, however, feed-forward target data is required that corresponds to the speed change generated when the sheet member is separated.

When the invention is applied to the fixation apparatus, a sheet member sensor unit is required to be provided between the secondary transfer apparatus 22 and the pressure roller 28. The sensor unit may be a kind similar to the sensor unit provided for the intermediate transfer apparatus. Further, when a similar feed-forward control is performed in the intermediate transfer apparatus, the sheet member sensor unit on the intermediate transfer apparatus side may be used.

When the sheet member sensor unit cannot be provided, operation signals of components in preceding stages of the secondary transfer apparatus 22, such as the operation control signal of the resist rollers 49, the control signal of the resist clutch, and the like may be used. Moreover, speed changes of the intermediate transfer belt 13, the support roller 16, the secondary transfer roller 23, and the like, which are generated when the sheet member enters the secondary transfer apparatus 22 may be sensed to sense the sheet member entering the fixation apparatus. Further, similar to the case of the intermediate transfer apparatus, the sheet member may contact the fixation belt before entering the secondary transfer apparatus 22.

In the case of performing the feed-forward control for a speed change generated when the sheet member is separated from the fixation apparatus, an abrupt speed change of the fixation apparatus is estimated by sensing the rear end of the sheet member with a sheet member sensor unit similar to the case of the intermediate transfer apparatus. Alternatively, speed changes of the intermediate transfer belt 13, the support roller 16, the secondary transfer roller 23, and the like, generated when the sheet member is separated from the secondary transfer apparatus 22 may be sensed by sensing that the sheet member is separated from the fixation apparatus. The control method is similar to the case where the sheet member enters the secondary transfer apparatus 22, however, feed-forward target data corresponding to the speed change generated when the sheet member is separated from the secondary transfer apparatus 22 is required.

As described above, according to at least one embodiment, there is provided a driving apparatus including a driving source, a driven unit driven by the driving source, a speed change sensor unit to sense an aperiodic speed change of the driven unit, and a driving control unit to perform feed-forward control using feed-forward target data set in advance to reduce the aperiodic speed change sensed by the speed change sensor unit. The speed change sensed by the speed change sensor unit is expressed as a sinusoidal waveform having a predetermined time duration and predetermined amplitude. The feed-forward target data is in a rectangular waveform formed by approximating the sinusoidal waveform obtained by the predetermined time duration and the predetermined amplitude. By using the amplitude of the rectangular waveform, which indicates the speed change data, as feed-forward target data, the feed-forward target value is the same at any time in a period in which the speed change is generated, since the amplitude of the rectangular waveform is constant. Therefore, when performing the feed-forward control, the control unit reads out the feed-forward target data from the recording unit only once. Only the read feed-forward target data is used as the feed-forward target data in the speed change period to perform the feed-forward control. As a result, the number of times that the control unit reads out the feed-forward target data from the recording unit can be reduced, and the work load on the control unit can be reduced by reading out the feed-forward target data from the recording unit. Therefore, manufacturing cost can be reduced since a high performance control unit is not required.

Further, since the feed-forward target value is the same at any time in the speed change period, only one feed-forward target data may be recorded as the feed-forward target data in the speed change period in the recording unit, for which less recording area is required in the recording unit. Thus, a recording unit with a large recording area is not required and manufacturing cost can be reduced.

Further, according to at least one embodiment, by controlling so that the rectangular waveform has approximately the same area as the sinusoidal waveform as described above, more precise feed-forward control can be performed.

Further, according to at least one embodiment, since the amplitude of the feed-forward target data is the maximum amplitude of the sinusoidal waveform and the time duration of the feed-forward target data is a time duration taken until the amplitude of the sinusoidal waveform reaches the maximum amplitude, more precise feed-forward control can be performed as described above.

Further, according to at least one embodiment, since the amplitude of the feed-forward target data is the maximum amplitude of the sinusoidal waveform and a time duration is the time duration of half of the maximum amplitude of the sinusoidal waveform, the feed-forward control can be performed with a high precision and the work load on the control unit can be reduced.

Further, according to at least one embodiment, the speed change is an average of plural speed changes generated in the driven unit. By using the average value of the plural speed changes, feed-forward target data is calculated. As a result, a stable feed-forward control effect can be obtained even when the speed changes of the driven unit vary.

Further, according to Embodiment 2, there is provided a multifunction peripheral as an image forming apparatus including a photosensitive drum 40 serving as a latent image support to support a latent image, a developer serving as a developing unit to develop the latent image on the photosensitive drum 40 into a toner image, an intermediate transfer unit to transfer the toner image on the photosensitive drum 40 onto the intermediate transfer belt 13 serving as an intermediate transfer body, a secondary transfer apparatus 22 serving as a secondary transfer unit to transfer the toner image transferred on the intermediate transfer belt 13 onto a sheet member serving as transfer material, and the fixation apparatus 24 serving as a fixation unit to fix the toner image transferred onto the sheet member. By using the driving apparatus of an embodiment of the invention as a driving apparatus of at least one of a driving unit to drive the driving roller 14 included in the intermediate transfer unit and the fixation device 24, an abrupt speed change (changes in position and acceleration) generated in the intermediate transfer drum, the intermediate transfer belt, the fixation roller, the fixation belt, and the like can be suppressed. As a result, degradation of the image to be formed can be suppressed. Moreover, by converting the feed-forward target data into a rectangular waveform, the work load on the operations unit and a recording area to be used are largely reduced and the feed-forward control can be implemented at lower cost.

Further, according to at least one embodiment, the estimation unit is the sheet member sensor unit which can perform the feed-forward control for an abrupt speed change generated by the entering sheet member at an appropriate timing.

Further, according to Embodiment 2, when the sheet member sensor unit estimates that the sheet member has entered the secondary transfer unit of the secondary transfer apparatus 22, the driving control unit 4 performs feed-forward control of the driving unit which drives the driving roller 14. As a result, an abrupt speed change generated in the intermediate transfer belt 13 when the sheet member enters the secondary transfer unit of the secondary transfer apparatus 22 can be suppressed.

Further, according to Embodiment 2, when the sheet member sensor unit estimates that the sheet member is separated from the secondary transfer unit of the secondary transfer apparatus 22, the driving control unit 4 performs feed-forward control of the driving source 1. As a result, an abrupt speed change generated in the intermediate transfer drum and the intermediate transfer belt when the sheet member is separated from the secondary transfer unit of the secondary transfer apparatus 22 can be suppressed.

Further, according to Embodiment 2, when the sheet member sensor unit estimates that the sheet member has entered a fixation unit of the fixation apparatus 24, the driving control unit 4 performs feed-forward control of the driving source 1.

As a result, an abrupt speed change generated in the fixation roller 27 and the fixation belt 25 when the sheet member enters the fixation unit of the fixation apparatus 24 can be suppressed.

Further, according to Embodiment 2, when the sheet member sensor unit estimates that the sheet member is separated from the fixation unit of the fixation apparatus 24, the driving control unit 4 performs feed-forward control of the driving source 1. As a result, an abrupt speed change generated in the fixation roller 27 and the fixation belt 25 when the sheet member is separated from the fixation unit of the fixation apparatus 24 can be suppressed.

This patent application is based on Japanese Priority Patent Application No. 2007-326798 filed on Dec. 19, 2007, the entire contents of which are hereby incorporated herein by reference.

What is claimed is:

1. An image forming apparatus comprising:

a latent image support configured to support a latent image;

a developing unit configured to develop the latent image on the latent image support into a toner image;

an intermediate transfer unit configured to transfer the toner image on the latent image support onto an intermediate transfer body;

a secondary transfer unit configured to transfer the toner image transferred onto the intermediate transfer body onto a sheet member;

a fixation unit configured to fix the toner image transferred onto the sheet member, a driving apparatus used as a driving unit of at least one of the intermediate transfer unit and the fixation unit;

the driving apparatus comprising: a driving unit;

a driven unit driven by the driving unit;

a driving control unit configured to control the driving unit by performing feed-forward control based on feed-forward target data determined in advance to reduce a speed change of the driven unit, wherein the speed change of the driven unit is expressed substantially as a positive half cycle of a sinusoidal waveform having an amplitude and a time duration, and the feed-forward target data is calculated from the amplitude and the time duration to represent a rectangular waveform approximating the positive half cycle of the sinusoidal waveform.

2. The image forming apparatus as claimed in claim 1, further comprising a speed change sensor unit configured to sense the speed change of the driven unit, wherein the speed change of the driven unit is reduced by using the speed change sensed by the speed change sensor unit and the feed-forward target data.

3. The image forming apparatus as claimed in claim 1, wherein the rectangular waveform has approximately the same area as an area of the positive half cycle of the sinusoidal waveform.

4. The image forming apparatus as claimed in claim 1, wherein an amplitude of the feed-forward target data is a maximum amplitude of the positive half cycle of the sinusoidal waveform, and a time duration of the feed-forward target data is a time duration taken until the amplitude of the positive half cycle of the sinusoidal waveform reaches the maximum amplitude.

5. The image forming apparatus as claimed in claim 1, wherein an amplitude of the feed-forward target data is a maximum amplitude of the positive half cycle of the sinusoidal waveform, and a time duration of the feed-forward target data is a time duration of a half maximum amplitude of the positive half cycle of the sinusoidal waveform.

6. The image forming apparatus as claimed in claim 1, wherein the speed change is an average value of plural speed changes of the driven unit.

7. The image forming apparatus as claimed in claim 6, further comprising an estimation unit configured to estimate a timing at which the sheet member enters a secondary transfer part formed of the intermediate transfer unit and the secondary transfer unit, wherein the feed-forward control is performed at the timing estimated by the estimation unit.

8. The image forming apparatus as claimed in claim 7, wherein the estimation unit is a sheet member sensor unit configured to sense the sheet member.

9. The image forming apparatus as claimed in claim 6, further comprising an estimation unit configured to estimate a timing at which the sheet member is separated from a secondary transfer part formed of the intermediate transfer unit and the secondary transfer unit, wherein the feed-forward control is performed at the timing estimated by the estimation unit.

10. The image forming apparatus as claimed in claim 9, wherein the estimation unit is a sheet member sensor unit configured to sense the sheet member.

11. The image forming apparatus as claimed in claim 6, further comprising an estimation unit configured to estimate a timing at which the sheet member enters a fixation part of the fixation unit, wherein the feed-forward control is performed at the timing estimated by the estimation unit.

12. The image forming apparatus as claimed in claim 11, wherein the estimation unit is a sheet member sensor unit configured to sense the sheet member.

13. The image forming apparatus as claimed in claim 6, further comprising an estimation unit configured to estimate a timing at which the sheet member is separated from a fixation part of the fixation unit, wherein the feed-forward control is performed at the timing estimated by the estimation unit.

14. The image forming apparatus as claimed in claim 13, wherein the estimation unit is a sheet member sensor unit configured to sense the sheet member.

* * * * *